United States Patent [19]

Broberg

[11] Patent Number: 4,734,104

[45] Date of Patent: Mar. 29, 1988

[54] COATED ABRASIVE PRODUCT INCORPORATING SELECTIVE MINERAL SUBSTITUTION

[75] Inventor: David E. Broberg, St. Paul, Minn.

[73] Assignee: Minnesota Mining and Manufacturing Company, St. Paul, Minn.

[21] Appl. No.: 852,096

[22] Filed: Apr. 14, 1986

Related U.S. Application Data

[63] Continuation of Ser. No. 721,869, Apr. 10, 1985, abandoned, which is a continuation-in-part of Ser. No. 608,480, May 9, 1984, abandoned.

[51] Int. Cl.[4] ..... C09C 1/68

[52] U.S. Cl. ..... 51/295; 51/309

[58] Field of Search ..... 51/295, 309

[56] References Cited

U.S. PATENT DOCUMENTS

| | | | |
|---|---|---|---|
| Re. 31,620 | 7/1984 | Leahy | 51/295 |
| 1,616,531 | 2/1927 | King . | |
| 2,410,506 | 11/1946 | Kirchner et al. | 51/188 |
| 3,181,939 | 5/1965 | Marshall et al. | 51/209 |
| 3,205,054 | 9/1965 | Tucker et al. | 51/298 |
| 3,266,878 | 8/1966 | Timmer | 51/298 |
| 3,806,956 | 4/1974 | Supkis et al. | 51/295 |
| 3,867,795 | 1/1975 | Howard | 51/209 |
| 3,891,408 | 6/1975 | Rowse et al. | 51/295 |
| 3,893,826 | 7/1975 | Quinan et al. | 51/295 |
| 3,996,702 | 12/1976 | Leahy | 51/328 |
| 4,038,046 | 7/1977 | Supkis | 51/295 |
| 4,217,113 | 8/1980 | Suh et al. | 51/309 |
| 4,314,827 | 2/1982 | Leitheiser et al. | 51/298 |

*Primary Examiner*—Paul Lieberman
*Assistant Examiner*—Willie J. Thompson
*Attorney, Agent, or Firm*—Donald M. Sell; James A. Smith; Richard E. Brink

[57] ABSTRACT

Replacement of all or most of the coarse mineral in a coated abrasive product by a superior (and typically more expensive) mineral improves abrading performance significantly more than would be predicted. In some cases the performance is superior to that of products made with either mineral alone. Typically 5% to 30% of the total mineral weight is made up of the superior mineral.

16 Claims, No Drawings

COATED ABRASIVE PRODUCT INCORPORATING SELECTIVE MINERAL SUBSTITUTION

CROSS-REFERENCE TO RELATED CASE

This is a continuation of application Ser. No. 721,869 filed Apr. 10, 1985 now abandoned.

BACKGROUND OF THE INVENTION

This invention relates to coated abrasive products and is especially concerned with coated abrasive products using two or more different abrasive minerals.

The mineral used in coated abrasive products made in the United States of America conventionally meets American National Standards Institute, Inc. (ANSI) standards, which specify that the particle size distribution for each nominal grade falls within numerically defined limits. According to the ANSI standards, any nominal grade is made up of three particle size fractions, viz., a "control" fraction, an "overgrade" fraction containing large particles nominally one fraction coarser than the control fraction, and a "fine" fraction containing small particles finer than the control fraction. Additionally ANSI standards permit the inclusion of up to 0.5% particles coarser than the overgrade fraction. The percentage of particles falling within each fraction varies from grade to grade; in general, however, about 50–60% are in the control fraction, about 10% in the overgrade fraction and about 30–40% in the fine fraction. When considered as a total, the sum of the three fractions is referred to as "full grade."

As used in the preceding paragraph, the term "grade" refers to a specified combination of abrasive particles as related to the standard mesh screens through which the particles will or will not pass. To illustrate, ANSI publication B74.18-1977 provides that a coated abrasive product having a nominal Grade 50 mineral coat will contain a control fraction which will pass through a 48.5-mesh (1 Std.) screen but not through a 58.5-mesh (3 Std.) screen, an overgrade fraction that will pass through a 37-mesh (38 GG) screen but not a 48.5-mesh (1 Std.) screen, and a fine fraction that will pass through a 58.5-mesh (3 Std.) screen. Additionally, Grade 50 may include up to 0.5% of extra-coarse particles that pass through a 32-mesh (32 GG) but not through a 38-mesh (38 GG) screen. The term "mesh" refers to the number of openings per lineal inch in the screen. Grading systems employed in foreign countries also utilize screens but vary somewhat as to the exact particle size, the number of screens and the percentage of particles falling in the several fractions that collectively make up a "full grade". Like the ANSI system, the Japanese grading system employs three fractions; the European grading system effectively includes four fractions, the coarsest three of which correspond roughly to the ANSI overgrade and control fractions. As a point of interest, the various grading systems are all intended to provide complete utilization of all the particles obtained during the process of crushing the originally supplied lumps of raw abrasive mineral.

For any given abrading operation, some types of abrasive mineral are more effective than others. For most metal abrading operations, however, the most widely used mineral has long been fused aluminum oxide, or alumina. In recent years, superior minerals have been developed by the co-fusion of alumina and zirconia; see, e.g., U.S. Pat. Nos. 3,181,939, 3,891,408, and 3,893,826. Another recently developed superior mineral, described in U.S. Pat. No. 4,314,827, is a non-fused synthetic alumina-based mineral containing certain metal oxide and/or spinel additives. Both the co-fused alumina:zirconia and the non-fused ceramic products are significantly more expensive than the conventional fused alumina, as, of course, are the coated abrasive products made with such minerals. Other slightly superior—and comparatively expensive—alumina-based minerals may be obtained by specially heat treating or coating conventional fused alumina.

It has been suggested that various types of minerals can be blended in making coated abrasive products; see, e.g., U.S. Pat. No. 3,205,054. One commercial product embodying this concept incorporates a full-grade blend of conventional fused alumina and the significantly more expensive co-fused alumina:zirconia. See also U.S. Pat. Nos. 2,410,506 and 3,266,878, showing the use of inexpensive "diluent" grain blended with diamond particles of the same grade. U.S. Pat. No. 3,996,702 describes the blending of co-fused alumina:zirconia with flint, garnet, or fused alumina of the same grade, and U.S. Pat. No. 4,314,827 suggests blending non-fused alumina-based abrasive grain with conventional fused alumina of the same grade.

In the manufacture of molded fabric-reinforced abrasive grinding wheels, several combinations of abrasive grain have been suggested for use in different layers of the construction. For example, U.S. Pat. No. 1,616,531 describes the use of different particle size mineral in the various abrasive layers. U.S. Pat. No. 3,867,795 describes the blending of expensive co-fused alumina:zirconia with flint, emery, silicon carbide, fused alumina, etc. in the various layers of relatively thin snagging wheels for use on portable grinders. One suggested construction in the latter patent utilizes conventional fused alumina in one layer with a blend of co-fused alumina:zirconia and a coarser garnet in the work-contacting surface.

Although products of the type described in the preceding paragraphs have managed to reduce the overall cost of the mineral applied in the coated abrasive construction, there has remained a strong desire to obtain the benefits of the superior mineral products while further minimizing the amount of the superior mineral present.

BRIEF DESCRIPTION OF THE INVENTION

The present invention provides coated abrasive products having excellent abrading effectiveness, utilizing the advantages inherent in superior abrasive grains while minimizing the quantity of such grains actually employed. Indeed, in some instances synergistic effects are obtained, the construction actually performing better than coated abrasive products in which only the superior mineral is present.

The present invention combines a minor portion of superior abrasive grains and the balance, correspondingly constituting a major portion, of inferior abrasive grains in such a way that most of the superior grain is concentrated in the coarsest portion. The unexpectedly good performance contributed by the superior grain can sometimes be detected in quantities as low as 1% by weight, but 3% of the superior grain contributes more consistently significant improvement. For most purposes, the superior abrasive grain will constitute 5% to 30% (preferably 10% to 20%) of the total mineral weight. It is technically feasible to add up to 50% of the superior grain, but the additional cost generally will not justify doing so. Thus, the invention can be broadly characterized as a coated abrasive product having a specified nominal grade of abrasive granules firmly adherently bonded to a sheet backing, the particle size of the granules ranging from large, or coarse to small, or fine. The granules consist essentially of two types of mineral, one type being present as a minor portion and demonstrably superior to an equivalent grade of the other type in the abrading operation for which the coated abrasive product is intended to be used, most of the superior mineral being concentrated in the coarser portion of the particles.

As will be shown, products corresponding to the invention can be made utilizing either a single application of blended abrasive grains or a multiple coating operation in which the first mineral coat does not conform to conventional mineral grading specifications because it exceeds the limits for fine particles, and the second mineral coat does not conform to conventional mineral grading specifications because it exceeds the limits for coarse particles. In this construction, the coarse fraction, which consists essentially of the superior mineral, is present in the second coat. The overall composition of the two mineral layers is, however, in full compliance with mineral grading specifications.

DESCRIPTION OF PRESENTLY PREFERRED EMBODIMENTS

Although the terms "superior" and "inferior" might seem to involve a considerable degree of subjectivity, those skilled in the coated abrasive art are quite capable of making such judgments. It is, of course, true that superiority or inferiority depends to some degree on the type of workpiece and the abrading conditions employed. Thus, for an ultimate determination of relative "superiority" and "inferiority" for two types of abrasive grain, coated abrasive products made with each of the two types should be tested under the specific grinding conditions of interest, using workpieces of the type to be abraded. For the present most commercially significant abrading operations, however, it has been found that a test involving the abrasion of cold rolled steel with coated abrasive products having only one specific type of abrasive grain bonded to the backing will, when compared to an identical construction involving a different abrasive grain, yield test results that are highly reliable in categorizing abrasive grain as to relative superiority or inferiority. This test will now be described in more detail.

A pre-weighed cold rolled steel workpiece (SAE 1018) 1 inch×2 inches×7¼ inches (approximately 2.5×5×18 cm), mounted in a holder, is positioned vertically, with the 1-inch×7¼ inch (2.5×18-cm) face confronting a 14-inch (approximately 36-cm) diameter 65 Shore A durometer serrated rubber contact wheel over which is entrained a Grade 50 belt to be tested. The workpiece is then reciprocated vertically through a 7¼-inch (18-cm) path at the rate of 20 cycles per minute, while a spring-loaded plunger urges the workpiece against the belt with a force of 25 lbs (11.3 kg) as the belt is driven at 5500 surface feet (about 1675 meters) per minute. After one minute elapsed grinding time, the workpiece is pulled away from the moving belt, the first workpiece-holder assembly removed and reweighed, the amount of stock removed calculated by subtracting the abraded weight from the original weight, and a new pre-weighed workpiece and holder mounted on the equipment. Using four workpieces, this procedure is repeated for a total of 88 minutes or until the cut per minute is 25 grams or less, whichever occurs sooner. With coarser or finer grades of mineral, abrading force may be respectively increased or decreased and final cut figures likewise adjusted.

Because there is inevitably some variation among presumably identical belts and presumably identical workpieces, the total cut values are considered accurate to ±5%; thus, if a belt from one lot cuts over 10% more than a belt from another lot, the first belt is deemed "superior" and the second "inferior". As might be expected, a higher degree of reliability is achieved if duplicate belts are tested.

Using the test procedure just described, the total cut values tabulated below were obtained for a series of belts made to ANSI standards using solely the type of coated abrasive mineral indicated. In each case, the cut figure is the average of at least two belts.

| Mineral Designation | Type of Grade 50 Mineral | Time, Minutes | Total Cut, Grams |
|---|---|---|---|
| AO | Conventional fused alumina | 56 | 2779 |
| AZ | Co—fused alumina-zirconia | 56 | 4580 |
| CUB | Non-fused alpha alumina containing certain metal oxides and/or spinels | 88 | 8094 |
| HT | Heat-treated fused alumina | — | — |

The mineral designations listed above will be used in the following description and examples.

EXAMPLES 1-3

Each of the following examples was prepared using a conventional cloth backing, viz., rayon drills saturated with a blend of synthetic rubber latex and phenolic resin. A conventional calcium carbonate-filled phenol-formaldehyde make coat was applied, the mineral electrostatically coated in conventional manner, the make coat precured, a conventional calcium carbonate-filled size coat applied, and both make and size coats then final cured. The only difference between conventional ANSI Grade 50 coated abrasive belt stock and the products of these examples, then, resided in the specific abrasive grain, or combination of grains, employed. In each of the examples made according to the invention, the abrasive grain was a blend of (1) the fine and control fractions of conventional Grade 50 fused alumina mineral, and (2) as a replacement for the coarse (overgrade) fraction, an equivalent weight of a full grade of Grade 40 superior mineral. (While it might be supposed that the overgrade fraction present in the full grade of the Grade 40 mineral would be excessively coarse for use in Grade 50, such is not the case in actual practice. There is considerable overlap in these two grades, but, as in normal manufacturing procedures, pre-coating screening removes any particles—perhaps 1%— that are larger than ANSI standards permit for Grade 50 products.)

Endless belts 3 inches (7.6 cm) wide×132 inches (335 cm) long were prepared from both conventional coated abrasive material and coated abrasive material made in accordance with the experimental examples. These belts were then entrained over a 20-inch (51-cm) diameter 65 Shore D durometer rubber contact wheel, serrated at a 45° angle to the lateral surfaces of the wheel, lands being ¾ inch (approximately 19 mm) wide and grooves one-third that dimension. The belts were then driven at 7380 surface feet (2250 meters) per minute while sets of pre-weighed metal test bars having either a rectangular or a circular cross section (approximate area 0.5–1 $in^2$, or about 3.2–6.4 $cm^2$) were urged against the belt under a pressure of either 100 or 150 psi (690 or 1035 kPa). Sets of 15 pre-weighed bars of SAE 1095 steel, 1018 steel, and 304 stainless steel were employed, while sets of 10 pre-weighed bars of Waspalloy and Inconel 600 were employed. Each bar was run for 5 seconds. Total cut figures are tabulated below:

TABLE I

| | | Total Cut, Grams, for Grade 50 Coated Abrasive Product Indicated | | | | | | | | | |
|---|---|---|---|---|---|---|---|---|---|---|---|
| | | 1095 Steel | | 1018 Steel | | 304 Stainless Steel | | Waspalloy | | Inconel 600 | |
| Example | Mineral | 100 psi | 150 psi | 100 psi | 150 psi | 100 psi | 150 psi | 100 psi | 150 psi | 100 psi | 150 psi |
| Control A | 100% AO | 195 | 266 | 180 | 221 | 253 | 317 | 176 | 134 | 537 | 415 |
| Control B | 100% CUB | 342 | 468 | 355 | 397 | 358 | 570 | 389 | 325 | 767 | 671 |
| Control C | 100% AZ | 280 | 409 | 281 | 280 | 301 | 495 | 456 | 348 | 699 | 566 |
| Control D | 100% HT | 226 | 307 | 241 | 275 | 290 | 389 | — | — | — | — |
| 1 | 90:10 AO:CUB* | 276 | 357 | 241 | 289 | 320 | 444 | 263 | 174 | 725 | 567 |
| 2 | 90:10 AO:AZ* | 248 | 335 | 335 | 267 | 307 | 426 | — | — | — | — |
| 3 | 90:10 AO:HT* | 191 | 307 | 174 | — | 231 | — | — | — | — | — |

*All ratios are by weight. The densities of AO, CUB and HT are substantially the same, so the weight ratios and volume ratios are essentially the same. Because AZ has a considerably higher density, it would theoretically be necessary to employ a higher weight to arrive at a 10% volume concentration; practically, however, the comparatively small amount of AZ present does not justify such an adjustment.

If a straight line is drawn between the 100% AO and 100% CUB cut figures, it will be observed that the total amount of metal cut by Example 1 lies considerably above the interpolated value that would be predicted. The same is true for Examples 2 and 3, where the blends of "superior" AZ and HT minerals with the "inferior" AO perform better than would be expected.

EXAMPLE 4

A coated abrasive product was made by the same procedure as in Example 1, ANSI Grade 80 mineral being substituted for the ANSI Grade 50 and all coating weights adjusted appropriately. In other words, in this Example 4, the coarse fraction was made up of the full grade of Grade 60. Belts were prepared in the same manner as for Examples 1–3 and tested on a comparable piece of equipment, the differences being that the belt speed was 5500 surface feet (about 1675 meters) per minute and the pressure applied to the workpiece was either 30 or 75 psi (respectively about 207 or 517 kPa). For convenience in comparing results, cut figures have been converted to percentages, conventional fused alumina at 30 psi (207 kPa) being assigned the value of 100%.

TABLE II

| | | Total Cut, Grams, for Grade 80 Coated Abrasive Product Indicated | | | | | | | | | | | |
|---|---|---|---|---|---|---|---|---|---|---|---|---|---|
| | | 1095 Steel | | 1018 Steel | | 304 Stainless Steel | | Waspalloy | | Inconel 600 | | Cast aluminum, 300 Series | |
| Example | Mineral | 30 psi | 75 psi | 30 psi | 75 psi | 30 psi | 75 psi | 30 psi | 75 psi | 30 psi | 75 psi | 30 psi | 75 psi |
| Control E | AO | 100 | 111 | 100 | 89 | 100 | 178 | 100 | — | 100 | 99 | 100 | 218 |
| Control F | CUB | 143 | 310 | 115 | 244 | 127 | 308 | 129 | — | 121 | 210 | 112 | 332 |
| 4 | 90:10 AO:CUB | 121 | 177 | 135 | 135 | 232 | 622 | 195 | — | 210 | 422 | 109 | 348 |

It will be observed from the foregoing table that in almost every instance products containing only 10% of the CUB mineral performed more effectively than products made with either 100% of the "inferior" conventional fused alumina or 100% of the "superior" CUB mineral. This result is considered surprising and synergistic. Even in those instances where belts made with the blended mineral did not actually cut more stock than those made with either of the two component minerals, total cut was more than would be predicted from a linear interpolation based on the amount of the superior mineral present.

EXAMPLES 5–8

Coated abrasive belts were made as in Examples 1 and 4, (i.e., each containing 10% CUB) in Grades 36, 50, 60, and 80. These belts were then tested according to the method described earlier in connection with evaluating "superior" and "inferior" minerals; the tests were, however, run for a predetermined period of time, rather than to a predetermined cutting rate. This time was 40 minutes for the Grade 50 belts and 30 minutes for Grades 36, 60, and 80. The control belts for each grade were conventional products made with fused alumina. Results are tabulated below:

TABLE III

| | | Lab Tests | |
|---|---|---|---|
| Example | Grade | Abrading Force kPa | Total Cut, grams |
| Control G | 36 | 206 | 1356 |
| 5 | " | " | 2316 |
| Control A | 50 | 172 | 1672 |
| 6 | " | " | 2588 |
| Control H | 60 | 139 | 1236 |
| 7 | " | " | 2026 |
| Control E | 80 | 103 | 962 |
| 8 | " | " | 1661 |

The Grade 50 and Grade 80 belts were then field tested against the same controls, where results in grinding various cold rolled or tool steel workpieces were as follows:

TABLE IV

| | | Field Tests | | |
|---|---|---|---|---|
| | | No. of Pieces Finished | | |
| Example | Grade | Wrench Handles | Breaker Bars | Chisels |
| Control A | 50 | 600 | | |
| 6 | " | 1000 | | |
| Control E | 80 | | 140 | 65 |
| 8 | " | | 285 | 95 |

The preceding examples have all described coated abrasive products in which the abrasive grain was applied in a single coating. As has been pointed out above, coated abrasive products have sometimes been made by applying the abrasive grain in two separate stages, typically drop coating the bottom portion and subsequently electrostatically coating the top portion. This two-step procedure offers certain advantages in the practice of the present invention, where it is possible to divide the abrasive grains so that the first layer contains substantially no coarse particles, the second layer containing a disproportionately large percentage of coarse particles. Since, in practicing the present invention, the coarse particles are predominantly made up of a comparatively expensive "superior" mineral, the effect of the two-coat system is to provide a higher concentration of these particles in the abrading surface that initially contacts the material to be abraded. The following examples illustrate this type of contruction.

EXAMPLES 9–13

In each of these examples, one half the total weight of Grade 50 abrasive grain was applied in a first trip containing substantially only the fine and control fractions of conventional fused alumina, while the second half of the Grade 50 mineral was applied in the form of a blend of minerals containing, in an amount sufficient to constitute the ANSI standard coarse fraction for the two mineral layers combined, a specified percentage of a mineral superior to fused alumina. To help put the results into perspective, several controls were also provided. The nature of the examples and controls, together with the results of abrading tests similar to those described in Table I, is tabulated below:

TABLE V

| Example | First Mineral Coat | Second Mineral Coat | Total Cut, Grams, for Grade 50 Coated Abrasive Product Indicated: 1095 Steel 100 psi | 1095 Steel 150 psi | 1018 Steel 100 psi | 1018 Steel 150 psi | 304 Stainless Steel 100 psi | 304 Stainless Steel 150 psi | Waspalloy 100 psi | Waspalloy 150 psi | Inconel 600 100 psi | Inconel 600 150 psi |
|---|---|---|---|---|---|---|---|---|---|---|---|---|
| Control A | Single coat full grade 50 AO | | 195 | 266 | 180 | 221 | 253 | 317 | 176 | 134 | 537 | 415 |
| Control B | Single coat full grade 50 CUB | | 342 | 468 | 355 | 397 | 358 | 570 | 389 | 325 | 767 | 671 |
| Control C | Single coat full grade 50 AZ | | 280 | 409 | 281 | 280 | 301 | 495 | 456 | 348 | 699 | 566 |
| Control D | Single coat full grade 50 HT | | 226 | 307 | 241 | 275 | 290 | 389 | — | — | — | — |
| Control I | Full grade 50 AO | Full grade 50 CUB | 325 | 432 | 279 | 394 | 453 | 603 | — | — | — | — |
| Control J | " | Full grade 50 AZ | 285 | 414 | 277 | 344 | 407 | 523 | — | — | — | — |
| 9 | Fine & control grade 50 AO | 90:10 fine & control grade 50 AO:full grade 40 CUB | 221 | 341 | 231 | 276 | 266 | 369 | 242 | — | 650 | — |
| 10 | Fine & control grade 50 AO | 80:20 fine & control grade 50 AO:full grade 40 CUB | 292 | 388 | 324 | 345 | 318 | 433 | 266 | — | 696 | — |
| 11 | Fine & control grade 50 AO | 80:20 fine & control grade 50 AO:full grade 40 AZ | 253 | 368 | 254 | 258 | 374 | 501 | 440 | — | 510 | — |
| 12 | Fine & control grade 50 AO | 80:20 fine & control grade 50 CUB:full grade 40 CUB | 348 | 501 | 360 | 451 | 422 | 609 | 454 | — | 727 | — |
| 13 | Fine & control grade 50 AO | 80:20 fine & control grade 50 AZ:full grade 40 AZ | 337 | 440 | 296 | 347 | 374 | 501 | — | — | — | — |

Example 9 contains 5% CUB based on the total weight of mineral present. Similarly, Examples 10–13 contain 10% "superior" mineral based on the total weight of mineral present.

It will be observed that the performance of Examples 9–13 is significantly better than would be predicted from a linear interpolation between Control A and Controls B, C, and D (as appropriate) based on the percentage of "superior" mineral present.

EXAMPLES 14–17

The following examples were all prepared according to ANSI standards for Grade 40 product made on phenolic resin-bonded drills cloth backings, using conventional backing, make, size, and coating techniques except for the type of abrasive mineral and, for two of the examples, the method of applying such mineral. Endless belts were prepared from each lot of material and tested on SAE 1018 steel according to the method described earlier in connection with evaluating "superior" and "inferior" mineral; all tests were, however, run for a predetermined length of time (22½ minutes) instead of to a predetermined cutting rate, using a force of 43 lbs (19.5 kg). Results are tabulated below:

TABLE VI

| Example | Mineral | Total Cut, Grams |
|---|---|---|
| Control K | Full grade 40 AO | 2051 |
| Control L | Full grade 40 CUB | 4308 |
| 14 | 95:5 full grade 40 AO:full grade 40 CUB | 2236 |
| 15 | 95:5 fine & control fractions Grade 40 AO:full grade 36 CUB | 2501 |
| 16 | 70:30 full grade 40 AO:full grade 40 CUB | 3085 |
| 17 | 70:30 fine & control fractions grade 40 AO:full grade 36 CUB | 3999 |

The preceding examples have all been related to the manufacture of coated abrasive belts. The same principles and general types of construction are also applicable to the manufacture of coated abrasive discs made on 30-mil (about 0.76-mm) vulcanized fiber backing. The following examples are all Grade 50 products, made to conventional coating standards, with all components being conventional except for the mineral or mineral blend employed.

EXAMPLES 18–20

Cured 7-inch (17.8-cm) diameter discs were first conventionally flexed to controllably crack the hard bonding resins, mounted on a beveled aluminum back-up pad, and used to grind the face of a 1-inch (2.5-cm)×7¼-inch (18.4-cm) 1.25-cm×30-cm 1018 cold rolled steel workpiece. Each disc was driven at 5000 rpm while the portion of the disc overlying the beveled edge of the back-up pad contacted the workpiece with a force of 10 lbs (4.5 kg) or 15 lbs (6.8 kg), generating a disc wear path of 18.9 $in^2$ (about 120 $cm^2$). Each disc was used to grind 10 separate workpieces for 1 minute each, the cumulative cut figures being shown in Table VII below:

TABLE VII

| Example | Grade 50 Mineral | Total Cut, Grams, for Coated Abrasive Product Indicated | |
|---|---|---|---|
| | | 10 lbs. | 15 lbs. |
| Control M | Full grade 50 AO | 114 | 176 |
| Control N | Full grade 50 CUB | 394 | 535 |
| 18 | 95:5 fine & control grade 50 AO:full grade 40 CUB | 260 | 378 |
| 19 | 90:10 fine & control grade 50 AO:full grade 40 CUB | 316 | 456 |
| 20 | 2-trip - ½ full grade 50 AO followed by ½ (90:10 fine & control grade 50 AO:full grade 40 CUB) | 262 | 360 |

Once again it is noted that the abrading effectiveness of the examples is significantly greater than could have been predicted from a linear interpolation between Controls M and N.

EXAMPLES 21–28

Cured 7-inch (17.8-cm) diameter Grade 24 discs were prepared using different combinations of abrasive grains and tested under a 15-lb (33-kg) load in substantially the same manner as in Examples 18–20, but using an 8-inch (20-cm) long work piece. Results are tabulated below:

TABLE VIII

| Example | Mineral | Total Cut, Grams |
|---|---|---|
| Control O | Full grade AO | 50 |
| Control P | Full grade CUB | 673 |
| Control Q | Full grade $Si_3N_4$—coated SiC ("SNAG"), as in U.S. Pat. No. 4,505,720 | 604 |
| Control R | 70:3O full grade AO:full grade CUB | 468 |
| 21 | 70:30 (fine & control fractions AO): (control & coarse fractions CUB) | 574 |
| Control S | 90:10 full grade AO:full grade CUB | 247 |
| 22 | 90:10 (fine & control fractions AO): coarse fraction CUB | 321 |
| 23 | 90:9:1 (fine & control fractions AO): coarse fraction CUB:coarse fraction AO | 287 |
| Control T | 95:5 full grade AO:full grade CUB | 196 |
| 24 | 95:5 full grade AO:coarse fraction CUB | 200 |
| Control U | 97:3 full grade AO:full grade CUB | 96 |
| 25 | 97:3 full grade AO:coarse fraction CUB | 121 |
| Control V | 99:1 full grade AO:full grade CUB | 50 |
| 26 | 99:1 full grade AO:coarse fraction CUB | 58 |
| Control W | 70:30 full grade AO:full grade SNAG | 361 |
| 27 | 70:30 (fine and control fractions AO): control and coarse fractions SNAG | 434 |
| Control X | 90:10 full grade AO:full grade SNAG | 173 |
| 28 | 90:10 (fine & control fractions AO): coarse fraction SNAG | 250 |

It will be noted that the performance of the coated abrasive products made in accordance with the invention is not only consistently superior to that of coated abrasive products made with full grade blends but also superior to the performance that would be predicted by interpolating between the individual cut figures for the minerals blended.

It will be appreciated that the foregoing examples are only illustrative and that numerous changes can be made without departing from the invention. For example, more than one type of "superior" mineral, "inferior" mineral, or both may be employed. Similarly, the weight of abrasive grain applied in each layer of a multiple-coated product can be varied; further, more than two mineral layers may be applied.

I claim:

1. A coated abrasive product having a specified nominal grade of abrasive granules firmly adherently bonded to a sheet backing, the particle size of said granules ranging from fine to coarse, said granules consisting essentially of at least two types of mineral, one of said types being present as a minor portion and demonstrably superior to an equivalent grade of the other (inferior) type in the abrading operation for which said coated abrasive product is intended to be used, most of said superior mineral being concentrated in the coarse portion, whereby said coated abrasive product significantly outperforms a coated abrasive product that is identical except that either (a) it contains only inferior mineral or (b) the same minor amount of superior mineral is distributed throughout the fine to coarse particle size range in the same proportions as is the inferior mineral.

2. The product of claim 1 wherein the superior mineral constitutes from about 5% to about 30% of the total weight of abrasive granules.

3. The product of claim 1 wherein the abrasive granules are present in at least two layers, the superior mineral being located substantially entirely in the outermost layer.

4. The coated abrasive product of claim 1 wherein the abrasive granules consist essentially of at least two types of aluminum oxide-based mineral, one of said types being present as a minor portion and demonstrably superior to an equivalent grade of the other type in the abrasion of cold rolled steel, said superior aluminum oxide-based mineral being concentrated in the coarse portion.

5. The coated abrasive product of claim 4 wherein the superior aluminum oxide-based mineral is present in both the control fraction and the overgrade fraction, the amount of superior mineral in the coated abrasive product not exceeding about 30% of the total weight of mineral present.

6. The coated abrasive product of claim 5 wherein the superior aluminum oxide-based mineral consists essentially of all the fractions of the next coarser grade.

7. The coated abrasive product of claim 5 wherein the superior mineral constitutes at least 5% of the total weight of abrasive granules.

8. The coated abrasive product of claim 7 wherein the superior mineral constitutes from about 10% to about 20% of the total weight of abrasive granules.

9. The coated abrasive product of claim 8 wherein the abrasive granules are present in at least two layers, the superior aluminum oxide-based mineral being located substantially entirely in the outermost layer.

10. The coated abrasive product of claim 4 wherein the large particles consist essentially of co-fused alumina-zirconia and the balance of the particles consist essentially of fused alumina.

11. The coated abrasive product of claim 4 wherein the large particles consist essentially of non-fused synthetic granular mineral having a microcrystalline structure comprising a secondary phase of crystallites comprising modifying component in an alumina phase comprising alpha-alumina, said modifying component, on a volume percent of fired solids of the mineral, being selected from p1 (a) at least 10% of zirconia, hafnia, or a combination of the two, (b) at least 1% of a spinel derived from alumina and at least one oxide of a metal selected from cobalt, nickel, zinc, or magnesium, and (c) 1–45% of component (a) and at least 1% of component (b)

the balance of said particles consisting essentially of fused alumina.

12. The coated abrasive product of claim 11 wherein the superior mineral constitutes from about 5% to about 30% of the total weight of abrasive granules.

13. The coated abrasive product of claim 12 wherein the superior mineral consitutes from about 10% to about 20% of the total weight of abrasive granules.

14. The coated abrasive product of claim 1 wherein the relative superiority and inferiority of the minerals is established in accordance with the test for abrading cold rolled steel set forth herein.

15. The product of claim 14 wherein the superior mineral constitutes from 1 to 50% of the total mineral present.

16. The product of claim 14 wherein the large particles consist essentially of non-fused synthetic granular material having a microcrystalline structure comprising a secondary phase of crystallites comprising modifying component in an alumina phase comprising alpha-alumina, said modifying component, on a volume percent of first solids of the mineral, being selected from (a) at least 10% of zirconia, hafniz, or a combination of the two, (b) at least 1% of a spinel derived from alumina and at least one oxide of a metal selected from cobalt, nickel, zinc, or magnesium, and (c) 1–45% of component (a) and at least 1% of component (b), the balance of said particles consisting essentially of fused alumina.

* * * * *